US012312950B2

(12) United States Patent
Lan et al.

(10) Patent No.: US 12,312,950 B2
(45) Date of Patent: May 27, 2025

(54) IN-SITU DETECTION ROBOT AND DETECTION METHOD FOR GEOLOGICAL INFORMATION WITHOUT DISTURBANCE OF IN-SITU STRESS

(71) Applicant: Chang'an University, Xi'an (CN)

(72) Inventors: Hengxing Lan, Xi'an (CN); Mervyn Lan, Xi'an (CN); Bolong Li, Xi'an (CN); Zhonghong Dong, Xi'an (CN); Hongbing Zhang, Xi'an (CN); Weifeng Sun, Xi'an (CN); Bei Zhang, Xi'an (CN)

(73) Assignee: Chang'an University, Xi'an (CN)

( * ) Notice: Subject to any disclaimer, the term of this patent is extended or adjusted under 35 U.S.C. 154(b) by 0 days.

(21) Appl. No.: 18/530,265

(22) Filed: Dec. 6, 2023

(65) Prior Publication Data

US 2024/0295149 A1 Sep. 5, 2024

Related U.S. Application Data

(63) Continuation of application No. PCT/CN2023/124073, filed on Oct. 11, 2023.

(30) Foreign Application Priority Data

Mar. 3, 2023 (CN) ..... 202310198130.X

(51) Int. Cl.
*E21B 49/00* (2006.01)
*E21B 7/00* (2006.01)
(Continued)

(52) U.S. Cl.
CPC ..... *E21B 49/00* (2013.01); *E21B 7/005* (2013.01); *E21B 23/001* (2020.05); *E21B 47/007* (2020.05); *E21B 47/013* (2020.05)

(58) Field of Classification Search
CPC .. E21B 23/001; E21B 7/005; E21B 7/26–267; E21B 49/00; E21B 47/007; E21B 47/013
See application file for complete search history.

(56) References Cited

U.S. PATENT DOCUMENTS 3,077,235 A * 2/1963 Govin ..... E21B 10/32 175/391
4,230,191 A * 10/1980 Svirschevsky ..... E21B 10/083 175/94

(Continued)

*Primary Examiner* — Kristyn A Hall
(74) *Attorney, Agent, or Firm* — Bayramoglu Law Offices LLC

(57) ABSTRACT

An in-situ detection robot and method for geological information without disturbance of in-situ stress, including a sleeve, a drilling unit set at the top of the sleeve, a dumping unit set inside the sleeve, and a support propulsion unit is set outside the sleeve, the top of the dumping unit extends into the drilling unit, a detection unit is set between the drilling unit and the support propulsion unit, and the robot tail is connected to a control unit; the dumping unit is used to discharge soil drilled from a hole of the drilling unit to the ground, the support propulsion unit is used to realize support, the detection unit is used to detect geological information of surrounding environment of the robot, the control unit is used to control the drilling unit, the support propulsion unit and the detection unit, and the control unit collects and processes the geological information.

18 Claims, 7 Drawing Sheets

(51) Int. Cl.

| | |
|---|---|
| ***E21B 23/00*** | (2006.01) |
| ***E21B 47/007*** | (2012.01) |
| ***E21B 47/013*** | (2012.01) |

(56) References Cited

U.S. PATENT DOCUMENTS

| | | | | |
|---|---|---|---|---|
| 4,676,310 | A * | 6/1987 | Scherbatskoy | E21B 23/10 166/383 |
| 4,726,711 | A * | 2/1988 | Tian | E21B 7/26 405/184 |
| 2013/0199852 | A1* | 8/2013 | Malcolm | E21B 7/005 175/73 |

* cited by examiner

IN-SITU DETECTION ROBOT AND DETECTION METHOD FOR GEOLOGICAL INFORMATION WITHOUT DISTURBANCE OF IN-SITU STRESS

CROSS REFERENCE TO RELATED APPLICATIONS

This application is a continuation application of International Application No. PCT/CN2023/124073, filed on Oct. 11, 2023, which is based upon and claims foreign priority to Chinese Patent Application No. 202310198130.X, filed on Mar. 3, 2023, the entire contents of which are incorporated herein by reference.

TECHNICAL FIELD

The invention relates to the field of geological information detection, in particular to an in-situ detection robot and detection method for geological information without disturbance of in-situ stress.

BACKGROUND

The geological problems happen in the construction of the project, such as filling cracking, roadbed damage, etc., one of the important reasons for the difficulty in predicting and preventing such disasters is the lack of in-situ detection means of geological information. Therefore, the in-situ accurate detection of geological information is one of the important scientific problems to be solved urgently in the field of geological engineering research.

The existing detection methods mainly rely on artificial soil samples and the use of professional instruments for testing, also known as indoor tests. This kind of indoor test needs to take soil samples in the field, which not only destroys the original structure of the soil, but also completely releases the interaction force between the soil, the important geological information parameter of in-situ stress cannot be obtained, and the parameters related to in-situ stress, such as density, modulus, water content, etc., cannot be accurately obtained, such as the detection of loess moisture content, because the loess moisture content is the core geological information index that affects slope stability, its detection accuracy has received widespread attention. However, for the indoor detection method of on-site sampling, the migration route of water changes due to the release of the lateral pressure of the sample, and the size and distribution of water content also inevitably change. The test results cannot reflect the real underground geological information, and it is difficult to guarantee the accuracy of geological disaster prediction, so the development of in-situ geological information detection technology is required.

Compared with the indoor test, the in-situ detection can be completed under the actual environmental conditions of the detection area, and the obtained test data is more reliable. At present, the in-situ geological information detection work is often carried out by the large drilling equipment to prefabricate the detection hole with a certain aperture, and then the pipeline robot carries the detection instrument to go deep into the underground for detection. However, during the drilling process, the drill bit also disturbs the geological information around the hole, especially the hole wall, and changes the soil structure at the local position. In particular, the mechanical hole effect is generated after drilling, and the in-situ stress is partially released, although its influence is less than that of the cutting sampling method on the mechanical state of the sample, there is still a large in-situ stress disturbance. The in-situ stress disturbance further affects the accuracy of geological information detection, especially the accuracy of geological information detection on the surface of the hole wall, for example, all geological information detected by machine vision will be greatly affected. In a word, although the accuracy of the in-situ detection method is higher than that of the indoor test method, the test error caused by the in-situ stress disturbance during drilling needs further study, especially a kind of in-situ geological information detection technology without in-situ stress disturbance.

Aiming at this problem, the invention develops an in-situ detection robot and detection method for geological information without disturbance of in-situ stress. The robot has the function of self-excavation and geological information detection in the underground soil layer. The information detection is carried out during the excavation process, and the information acquisition under the condition of no stress release is realized, which avoids the detection error caused by the in-situ stress disturbance.

SUMMARY

In order to solve the technical problems existing in the ground information detection method of the existing small and medium-sized underground drilling robot, the purpose of this invention is to provide an in-situ detection robot and detection method for geological information without disturbance of in-situ stress, which can self-propelled drilling into the soil and realize the measurement of deep geological information parameters under the condition of no stress release.

In order to achieve the above tasks, the invention adopts the following technical solution:

An in-situ detection robot for geological information without disturbance of in-situ stress includes a sleeve, a drilling unit is set at a top of the sleeve, a dumping unit is set inside the sleeve, and a support propulsion unit is set outside the sleeve, a top of the dumping unit extends into the drilling unit, a detection unit is set between the drilling unit and the support propulsion unit, and a robot tail is connected to a control unit;

the dumping unit is used to discharge soil drilled by the drilling unit from a hole to the ground, the support propulsion unit is used to realize support, advancement, and self-adaptation of a robot body in the hole, and the detection unit is used to detect geological information of surrounding environment of the robot, the control unit is used to control the drilling unit, the support propulsion unit and the detection unit, and the control unit collects and processes the geological information transmitted by the detection unit;

the support propulsion unit includes a fore-body airbag, an after-body airbag, and an adaptive airbag which are coaxially arranged from top to bottom outside the sleeve, the fore-body airbag and the after-body airbag are connected by an axial contraction component, the after-body airbag is fixed with the adaptive airbag, the axial contraction component cooperates with the fore-body airbag and the after-body airbag to realize an axial movement of the fore-body airbag and the after-body airbag along an outer wall of the sleeve, so the robot can move forward and support in the hole, the adaptive airbag can realize an environmental adaptation of the robot so that the robot body can maintain stable.

Furthermore, the fore-body airbag includes a first inner shell that can be slidingly sleeved on the sleeve, the first inner shell is connected to a first outer shell through a first reinforcing rib, a first air cavity is attached to an outer wall of the first outer shell, and a first air pipe connected to the first air cavity is circumferentially arranged on the first outer shell;

structures of the after-body airbag and the adaptive airbag are the same as that of the fore-body airbag, the after-body airbag includes a second air cavity and a second air pipe connected to the second air cavity, the adaptive airbag includes a third air cavity and a third air pipe connected to the third air cavity, the first air pipe, the second air pipe, and the third air pipe are all connected to an external gas source;

the axial contraction component includes a third motor, a mutually matched screw, and a screw nut, the third motor is fixed between the first outer shell and the first inner shell of the fore-body airbag, the third motor is connected to the screw, the screw nut is fixed between the first outer shell and the first inner shell of the after-body airbag, the third motor drives the screw to rotate, and then the drilling unit is driven forward for drilling, or the after-body airbag is driven forward, thereby driving the adaptive airbag forward.

Furthermore, the drilling unit includes a PDC bit and a gear module set at a bottom of the PDC bit, the gear module includes an internal meshing large gear fixedly connected to the PDC bit, an internal meshing small gear set in the internal meshing large gear, and the internal meshing small gear is fixedly connected to the first motor, the first motor is set on the sleeve, and the first motor drives the internal meshing small gear to rotate, and then the internal meshing large gear is driven to rotate, further, the PDC bit is driven to rotate to realize a soil drilling.

Furthermore, the dumping unit includes a screw conveyor coaxial with the sleeve inside the sleeve, a pneumatic conveyor is connected to a bottom of the screw conveyor, the dumping unit also includes a cutting ring arranged at a bottom of the adaptive airbag, the screw conveyor conveys the soil cut by the PDC bit to the robot tail and discharges the robot body through the pneumatic conveyor;

the PDC bit is provided with a drill cavity, and the screw conveyor includes a first spiral blade located in the drill cavity and a second spiral blade located throughout the sleeve, the first spiral blade and the second spiral blade are connected to a second motor with a double output shaft, a diameter of the first spiral blade is greater than that of the second spiral blade.

Furthermore, the detection unit includes a second outer shell and a second inner shell coaxially arranged in the second outer shell, the second outer shell, and the second inner shell are divided into three mounting cavities by setting three second stiffeners, the three mounting cavities include a first mounting cavity, a second mounting cavity, and a third mounting cavity;

the first mounting cavity is equipped with a water tank and a first guide rod, the water tank is connected to a water pipe to inject water into external soil, and a loading plate is arranged at the end of the first guide rod, the loading plate assists the water tank to measure a slump modulus of the soil;

the second mounting cavity is equipped with a second guide rod, a strength probe is set at a front end of the second guide rod, and an airbag is set at a tail end of the second guide rod, the second guide rod pushes the strength probe into the soil to measure a soil strength through the compressed gas in the airbag;

the third mounting cavity is equipped with a moisture content detector and a pressure sensor; the pressure sensor detects a distribution and a size of the in-situ stress by contacting a hole wall.

Furthermore, an outer diameter of the second outer shell and an outer diameter of the cutting ring are ±1 mm different from an outer diameter of the PDC bit.

Furthermore, the control unit includes a computer, a power supply, a gas source, and a control circuit board, the computer and the power supply are connected to the robot by a cable, the gas source is communicated with the first air pipe, the second air pipe and the third air pipe through the fifth air pipe, and the gas source is controlled by a second butterfly valve for inflating and deflating gas.

Furthermore, the pneumatic conveyor includes a hopper, a pressure delivery tank, a mud pipe, and a ground mud pipe connected in turn, the pressure delivery tank is connected to a main pneumatic nozzle, the mud pipe is connected to an auxiliary pneumatic nozzle, and the main pneumatic nozzle and the auxiliary pneumatic nozzle are connected to the gas storage tank.

The invention also discloses a detection method of the in-situ detection robot for geological information without disturbance of in-situ stress, using the PDC bit for drilling to discharge drilled soil to the ground by the screw conveyor and the pneumatic conveyor, actuating the fore-body airbag, the after-body airbag and the adaptive airbag in turn to realize radial inflation and contraction through the external gas source, realizing an axial expansion and contraction by the axial contraction component, and also an adaptive environment, realizing a forward and supporting action by sequentially controlling the airbag and the second motor, detecting the surrounding environment in real time by the internal detection unit, and transmitting the data to the computer on the ground through the cable in the tail, acting to support the stability of the body by the adaptive airbag when encountering pore cracks in the forward direction.

Compared with the existing technology, the invention has the following technical effects:

(1) The robot has its own sensor, moisture content detector, loading plate, and strength probe, which can realize the measurement of soil mechanical parameters under the condition of no stress release without destroying the original soil morphology state, the detection accuracy is high, and the robot can measure soil modulus under the original stress state.

(2) The combination of the screw conveyor and the air pressure pump has high dumping efficiency and reduces the driving resistance, the reversal of the screw conveyor can clean up the soil in the tail and create conditions for the robot to retract.

(3) The strength of the PDC bit is greater than that of the spiral bit, which can achieve strong cutting for a hard underground environment, the special design increases the cavity volume of the drill gap, increases the dumping efficiency, and prevents soil blockage.

(4) The tail is equipped with an environmental adaptive airbag, which can support the robot when it encounters a large pore crack, maintain the stability of the body, and provide a strong tunneling feed force.

(5) The tail is equipped with a conical cutting ring with the same outer diameter as the PDC bit, when the robot is retracted, the soil caused by the shrinkage of the hole is cut, so that the robot is easy to retract and avoid the phenomenon of equipment blockage caused by the shrinkage of the soil hole.

MARKS IN THE FIGURES

Figure 1:
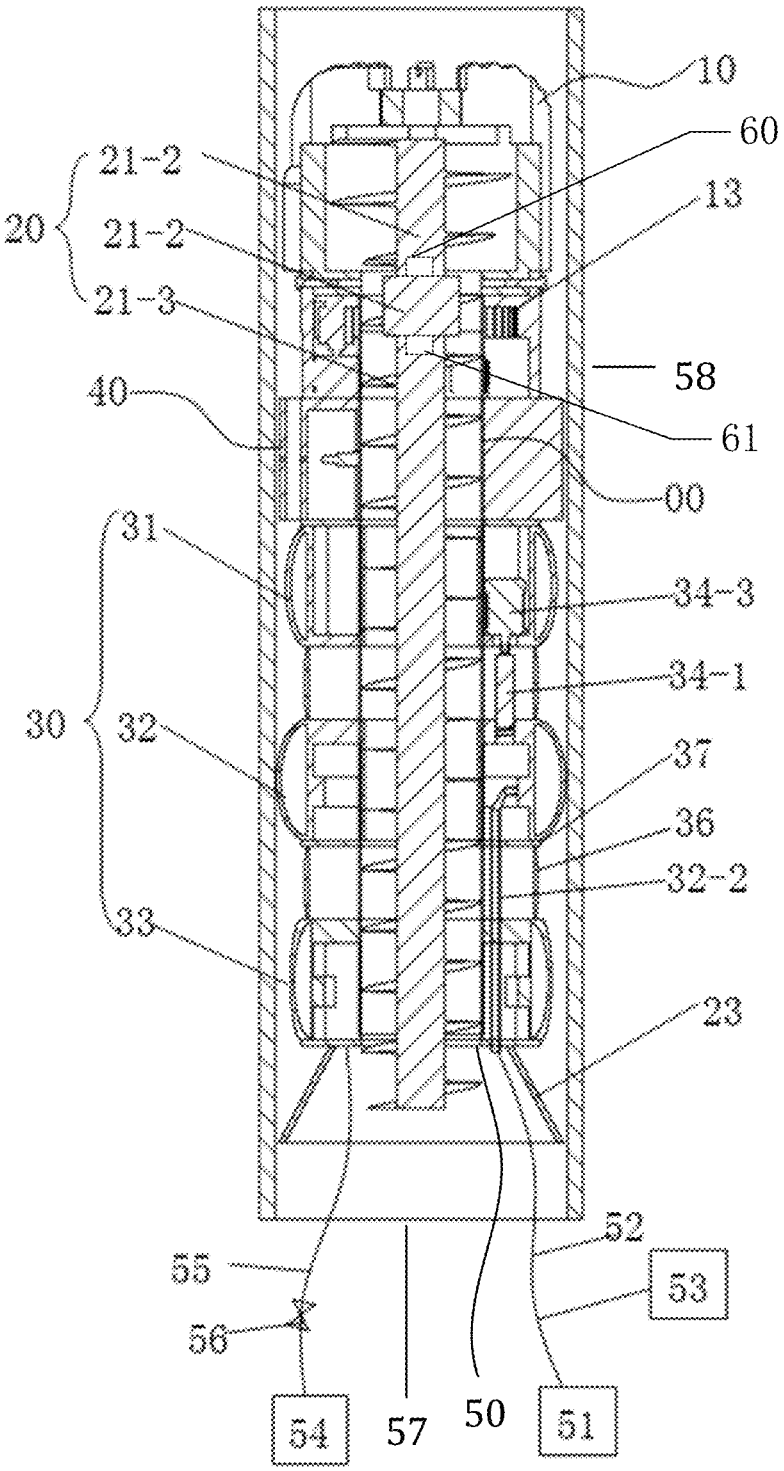
FIG. 1 is a schematic diagram of the profile structure of the robot of the invention.
Figure 2:
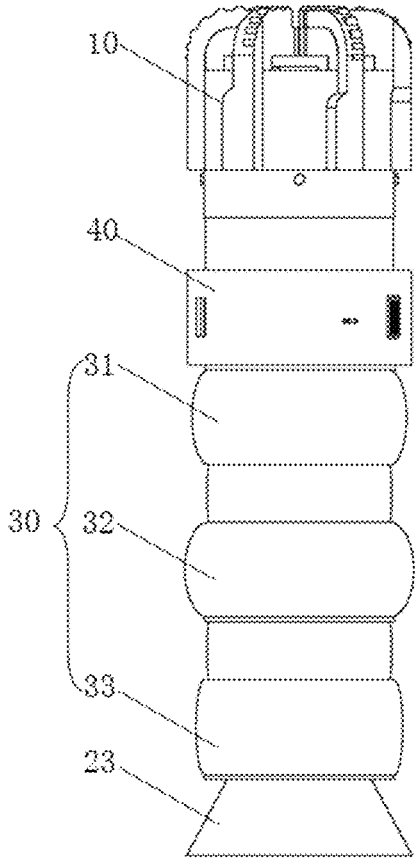
FIG. 2 is a schematic diagram of the robot structure of the invention.
Figure 3:
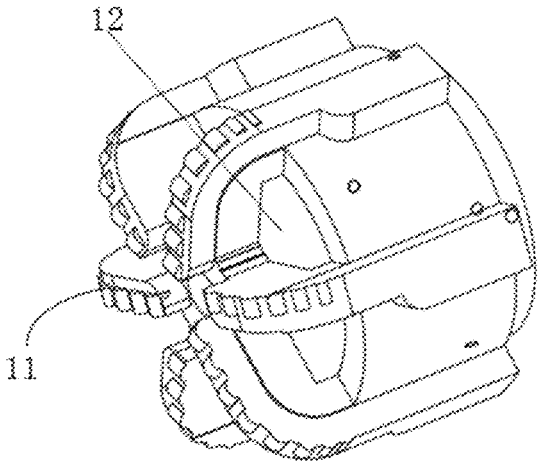
FIG. 3 is a schematic diagram of the PDC bit structure shown in FIG. 1.

00, sleeve; 10, drilling unit; 11, PDC bit; 12, drill cavity; 13, the first motor; 14, internal meshing pinion; 15, internal meshing large gear; 20, dumping unit; 21, screw conveyor; 21-1, the first spiral blade; 21-2, second motor; 21-3, second spiral blade; 22, pneumatic conveyor; 22-1, hopper; 22-2, feed butterfly valve; 22-3, pressure delivery tank; 22-4, discharge butterfly valve; 22-5, main pneumatic nozzle; 22-6, the first butterfly valve; 22-7, Laval nozzle; 22-8, gas storage tank; 22-9, mud pipe; 22-10, ground mud pipe; 22-11, auxiliary pneumatic nozzle; 23, cutting ring; 30, support propulsion unit; 31, fore-body airbag; 31-1, the first inner shell; 31-2, the first outer shell; 31-3, the first air cavity; 31-4, the first air pipe; 31-5, the first reinforcing rib; 32, after-body airbag; 32-1, the second air cavity; 32-2, second air pipe; 33, adaptive airbags; 33-1, the third air cavity; 33-2, the third air pipe; 34, axial contraction component; 34-1, screw; 34-2, screw nut; 34-3, the third motor; 36, sealing ring; 37, cover plate; 40, detection unit; 41, the second outer shell; 42, the second inner shell; 43, the second reinforcing rib; 44, the first mounting cavity; 44-1, water tank; 44-2, water pipe; 44-3, the first guide rod; 44-4, loading plate; 44-5, the first wire; 45, the second mounting cavity; 45-1, the second guide rod; 45-2, strength probe; 45-3, airbag; 45-4, the fourth air pipe; 46, the third mounting cavity; 46-1, moisture content detector; 46-2, pressure sensor; 46-3, circuit board; 46-4, the second wire; 50, control unit; 51, computer; 52, cable; 53, power supply; 54, gas source; 55, the fifth air pipe; 56, the second butterfly valve; 57, robot tail; 58, robot body; 59, gear module; 61, first output shaft; 62, second output shaft.

DETAILED DESCRIPTION OF THE EMBODIMENTS

The following is a further detailed description of the content of the invention in combination with the attached drawings and specific embodiments:

Embodiment 1

Combined with FIGS. 1-10, this embodiment discloses an in-situ detection robot for geological information without disturbance of in-situ stress, including the sleeve 00, the drilling unit 10 is set at the top of the sleeve 00, the dumping unit 20 is set inside the sleeve 00, and the support propulsion unit 30 is set outside the sleeve 00, the top of the dumping unit 20 extends into the drilling unit 10, the detection unit 40 is set between the drilling unit 10 and the support propulsion unit 30, and the robot tail 57 is connected to the control unit 50;

the dumping unit 20 is used to discharge soil drilled from the hole of the drilling unit 10 to the ground, the support propulsion unit 30 is used to realize support, advancement, and self-adaptation of the robot body 58 in the hole, the detection unit 40 is used to detect geological information of surrounding environment of the robot, the control unit 50 is used to control the drilling unit 10, the support propulsion unit 30 and the detection unit 40, each unit cooperates with each other to form the whole of the geological information in-situ detection robot, the robot has the advantages of simple structure, reliability, and low cost, it is suitable for geological information detection, the detection unit is sent to the deep part, and the detection task is completed under the condition of no stress release of soil, the in-situ detection condition makes the detection accuracy higher.

In this embodiment, the support propulsion unit 30 includes the fore-body airbag 31, the after-body airbag 32 and the adaptive airbag 33, which are coaxially arranged from top to bottom outside the sleeve 00, the fore-body airbag 31 and the after-body airbag 32 are connected by the axial contraction component 34, the after-body airbag 32 is fixed with the adaptive airbag 33, the axial contraction component 34 cooperates with the fore-body airbag 31 and the after-body airbag 32 to realize an axial movement of the fore-body airbag 31 and the after-body airbag 32 along the outer wall of the sleeve 00, so the robot can move forward and support in the hole, the adaptive airbag 33 can support the robot when it encounters the large pore crack, maintain the stability of the body, and provide the strong driving feed force.

Furthermore, the fore-body airbag 31 includes the first inner shell 33-1 that can be slidingly sleeved on the sleeve 00, the first inner shell 31-1 is connected to the first outer shell 31-2 through the first reinforcing rib 31-5, the first air cavity 31-3 is attached to the outer wall of the first outer shell 31-2, and the first air pipe 31-4 connected to the first air cavity 31-3 is circumferentially arranged on the first outer shell 31-2;

The structures of the after-body airbag 32 and the adaptive airbag 33 are the same as that of the fore-body airbag 31, the after-body airbag 32 includes the second air cavity 32-1 and the second air pipe 32-2 connected to the second air cavity 32-1, the adaptive airbag 33 includes the third air cavity 33-1 and the third air pipe 33-2 connected to the third air cavity 33-1, the first air pipe 31-4, the second air pipe 32-2 and the third air pipe 33-2 are all connected to the external gas source 54;

The air cavities are rubber airbag 45-3, which is bonded to the inner shell by adhesive, each air cavity is an integrated structure of casting molding, and the inner ring is equipped with an inflatable nozzle connected to the air pipe, which minimizes the leakage of air during the working process, so as to ensure the accuracy of the structure and action, the corresponding functions are achieved by the inflation and deflation of the air pipe. In addition, a sealing ring 36 is arranged between the fore-body airbag 31, the after-body airbag 32, and the adaptive airbag 33, and cover plates 37 are arranged at the ends.

The axial contraction component 34 includes the third motor 34-3, the mutually matched screw 34-1 and the screw nut 34-2, the third motor 34-3 is fixed between the first outer shell 31-2 and the first inner shell 31-1 of the fore-body airbag 31, the third motor 34-3 is connected to the screw 34-1, the screw nut 34-2 is fixed between the first outer shell 31-2 and the first inner shell 31-1 of the after-body airbag 32, the third motor 34-3 drives the screw 34-1 to rotate, and then the drilling unit 10 is driven forward for drilling, or the after-body airbag 32 is driven forward, thereby driving the adaptive airbag 33 forward.

Preferably, the third motor 34-3, the mutually matched screw 34-1, and the screw nut 34-2 belong to a group, and the three components are evenly distributed in the circumferential direction to maintain a stable forward movement, the axial telescopic mechanism is provided with a sealing sleeve in the circumferential direction to prevent the soil from entering the screw nut 34-2 to block the mechanism.

The fore-body airbag 31 and the after-body airbag 32 cooperate with the axial telescopic component to realize the advancement of the robot, the adaptive airbag 33 plays a role when the robot encounters special situations, that is, when the robot encounters a large pore crack in the process of moving, the support of the fore-body airbag 31 and the after-body airbag 32 can not play a role, the adaptive airbag 33 inflates and expands so that the robot is fixed in the hole to prevent the robot from overturning and affecting the normal work.

The support propulsion module realizes the stepping motion mode of the robot similar to the peristaltic motion of the earthworm, that is, when the robot completely enters the artificially preset hole, the fore-body airbag inflates and expands to make the robot fixed on the hole wall, and then the third motor 34-3 is energized to make the screw 34-1 rotate and drive the after-body airbag 32 to advance, then the after-body airbag 32 inflates and expands to realize that the robot moves an H-distance forward, the pressure of the airbag 45-3 is determined during the experiment, and the force feedback device is installed to adaptively adjust the opening size of the solenoid valve to control the air pressure, the forward distance of the screw can be controlled by the third motor 34-3, the third motor 34-3 meets the requirements of the robot to be fixed at each position, and the position feedback device can monitor the position of the robot in real time.

Figure 4:
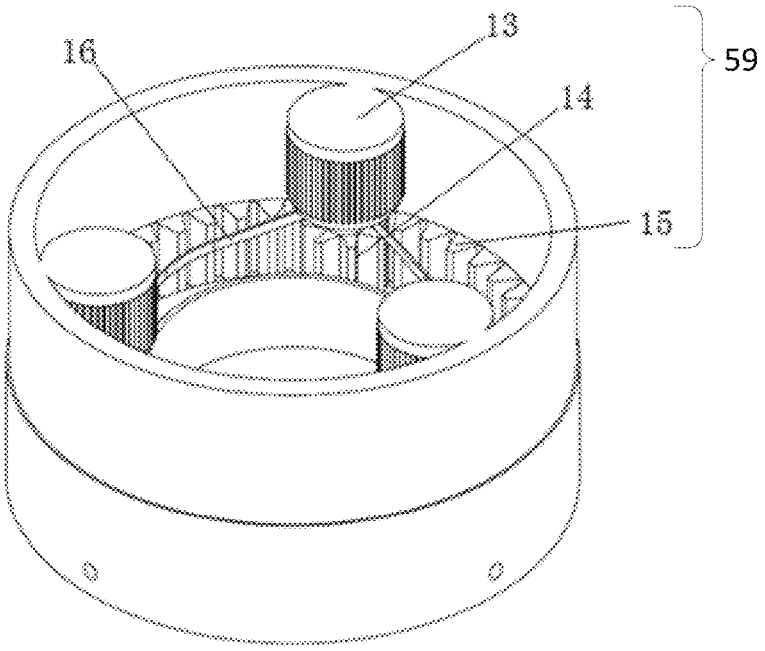
FIG. 4 is a schematic diagram of the gear module structure shown in FIG. 1.
Figure 5:
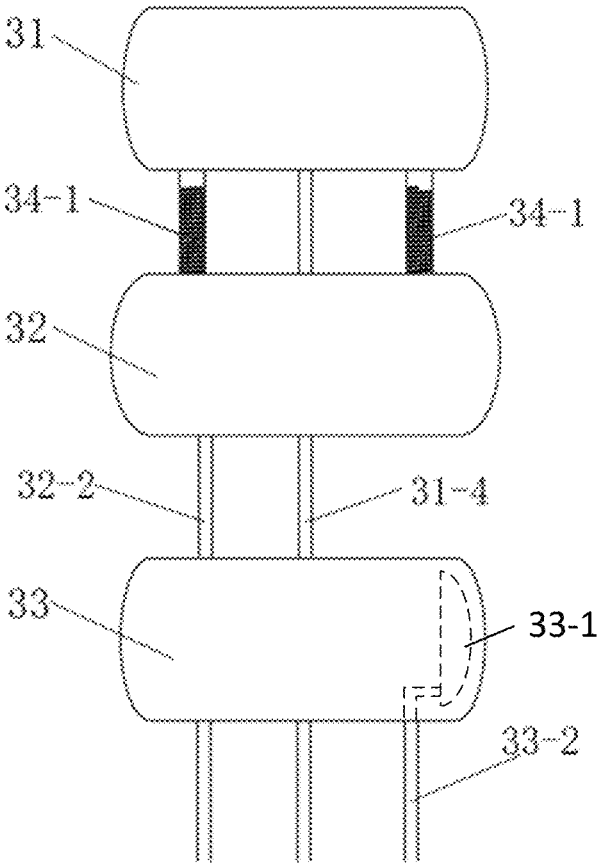
FIG. 5 is a schematic diagram of the support propulsion unit structure shown in FIG. 1.
Figure 6:
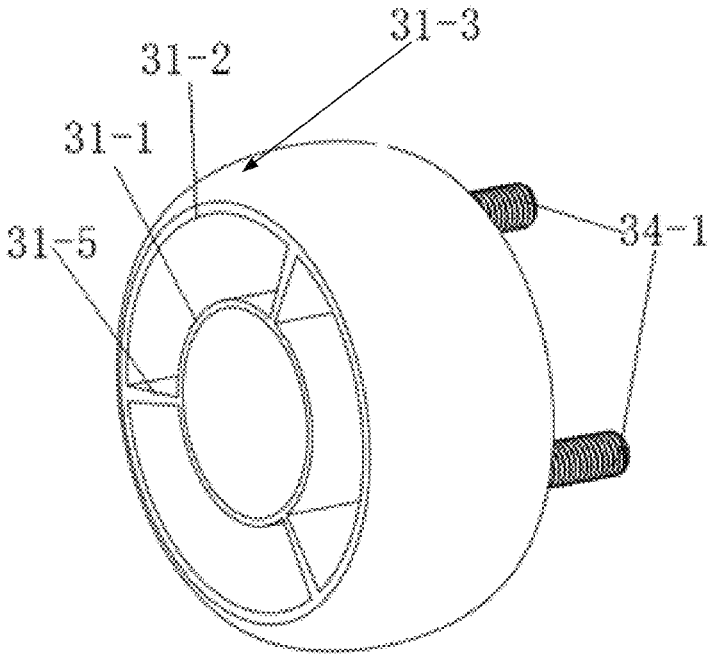
FIG. 6 is a schematic diagram of the fore-body airbag structure shown in FIG. 1.
Figure 7:
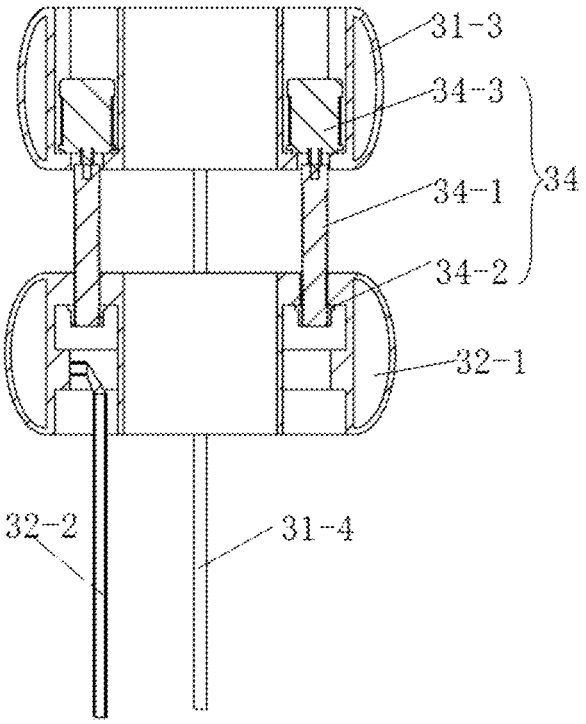
FIG. 7 is a local section view of the supporting propulsion unit shown in FIG. 1.
Figure 8:
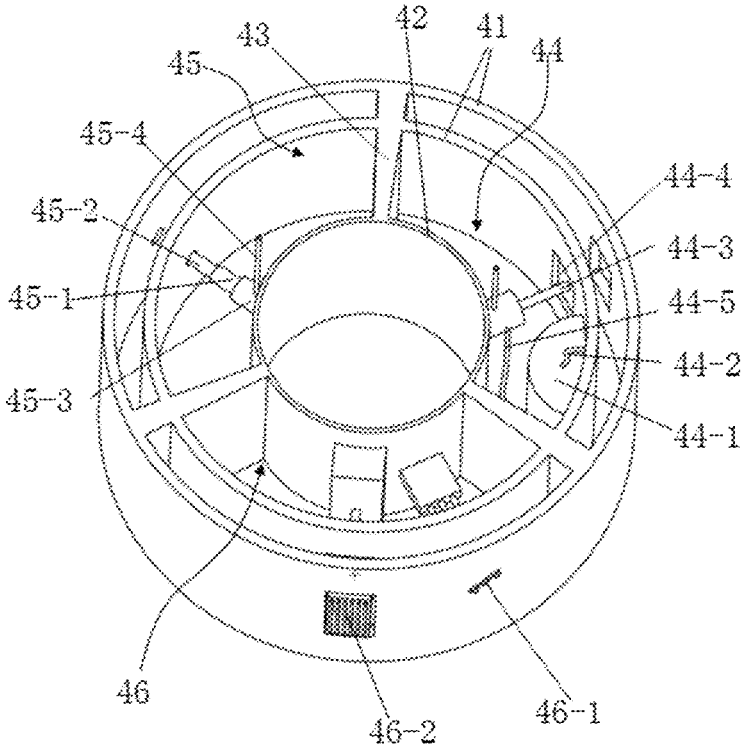
FIG. 8 is a schematic diagram of the detection unit structure shown in FIG. 1.
Figure 9:
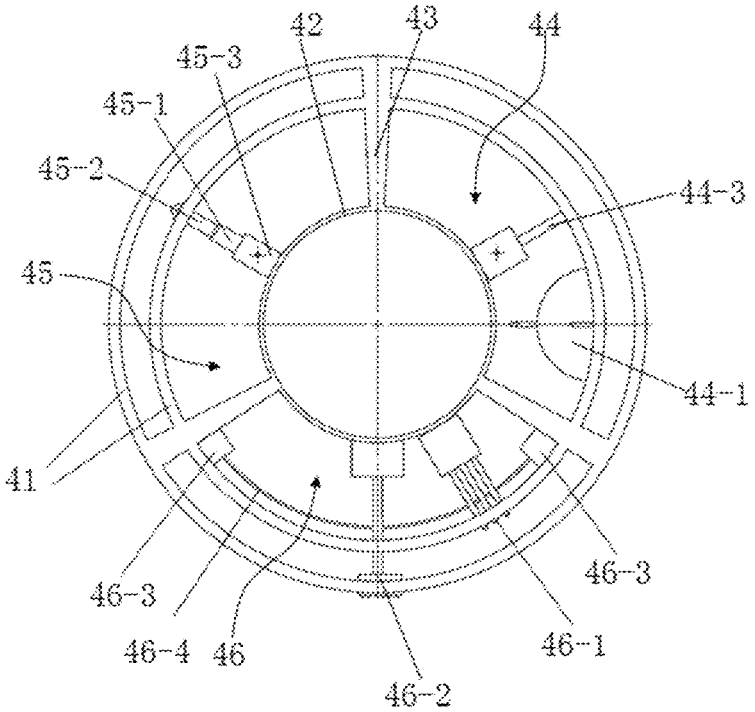
FIG. 9 is a top view of the detection unit shown in FIG. 1.
Figure 10:
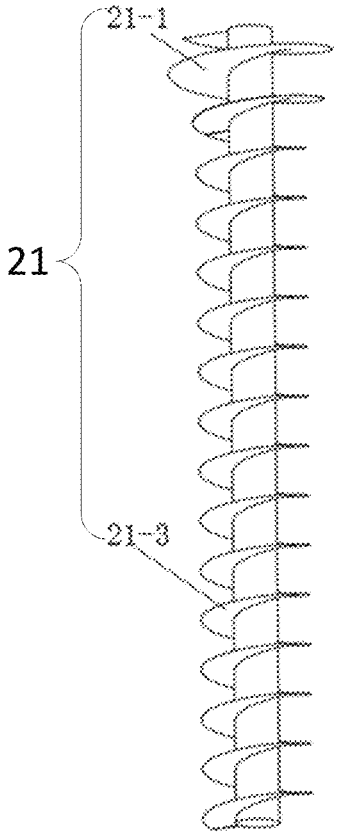
FIG. 10 is a local structure diagram of the screw conveyor shown in FIG. 1.
Figure 11:
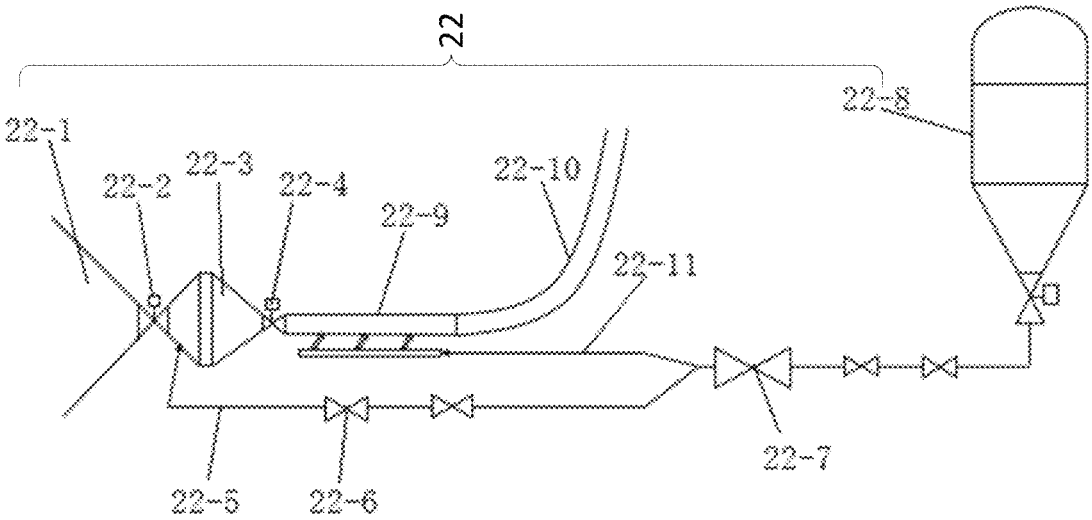
FIG. 11 is a schematic diagram of the principle of the pneumatic conveyor shown in FIG. 1.

Furthermore, the drilling unit 10 includes the PDC bit 11 and a gear module 59 set at the bottom of the PDC bit 11, the gear module 59 includes an internal meshing large gear 15 fixedly connected to the PDC bit 11, the internal meshing small gear 14 set in the internal meshing large gear 15, and the internal meshing small gear 14 is fixedly connected to the first motor 13, the first motor 13 is set on the sleeve 00, and the first motor 13 drives the internal meshing small gear 14 to rotate, and then the internal meshing large gear 15 is driven to rotate, further, the PDC bit 11 is driven to rotate to realize a soil drilling. As shown in FIG. 4, three first motors 13 are connected by the synchronous belt 16 before setting to ensure the same speed.

Preferably, the PDC bit 11 increases the volume of the drill cavity 12, which can accommodate more soil to prevent blocking, in this embodiment, the strength of the PDC bit is greater than that of a spiral bit, and a strong cutting can be achieved for hard underground environment, the special design increases the cavity volume of the drill gap, increases the dumping efficiency, and prevents soil blockage, which provides favorable conditions for in-situ detection of in-situ stress without disturbance. Furthermore, the dumping unit 20 includes the screw conveyor 21 coaxial with the sleeve 00 inside the sleeve 00, the pneumatic conveyor 22 is connected to the bottom of the screw conveyor 21, the dumping unit 20 also includes the cutting ring 23 arranged at the bottom of the adaptive airbag 33, the screw conveyor 21 conveys the soil cut by the PDC bit 11 to the robot tail 57 and discharges the robot body 58 through the pneumatic conveyor 22.

The PDC bit 11 is provided with the drill cavity 12, and the screw conveyor 21 includes the first spiral blade 21-1 located in the drill cavity 12 and the second spiral blade 21-3 located throughout the sleeve 00, the first spiral blade 21-1 and the second spiral blade 21-3 are connected to the second motor 21-2 with the double output shaft 61, 62, the diameter of the first spiral blade 21-1 is greater than that of the second spiral blade 21-3.

The purpose of this setting is to increase the efficiency of transporting soil and prevent the drill cavity from accumulating too much soil to cause a stuck, when the soil drilled by the PDC bit 11 enters the drill cavity 12, the second motor 21-2 rotates to drives the screw conveyor 21 to rotate, so as to send the soil from the head to the tail, and the soil from the tail will be transported to the ground by the pneumatic conveyor 22, the second motor 21-2 has a double output shaft 61, 62, which can be added to the reducer to output different speeds, the double output shaft 61, 62 is connected to the front and rear parts of the screw rod through the connecting pin to rotate at the same time, the second motor 21-2 is externally welded with a fixed plate, and the fixed plate is fixed with the sleeve 00. The dumping form of screw conveyor 21 is inner dumping, by optimizing the structural parameters such as pitch, outer diameter, core diameter, length, and speed, and adopting the form of positive and negative rotation, the dumping efficiency can be improved and the stuck can be prevented, when reversing, the tail soil can be cleaned to create conditions for the robot to retract.

Furthermore, the detection unit 40 includes the second outer shell 41 and the second inner shell 42 coaxially arranged in the second outer shell 41, the second outer shell 41 and the second inner shell 42 are divided into three mounting cavities by setting three second stiffeners 43, the three mounting cavities include the first mounting cavity 44, the second mounting cavity 45 and the third mounting cavity 46, the second outer shell 41 has a double-layer with a guide hole to facilitate the extension of the detection instrument, each guide hole is sealed by a rubber sleeve to prevent water and soil particles from entering the detection instrument and causing damage to the instrument.

The first mounting cavity 44 is equipped with the water tank 44-1 and the first guide rod 44-3, the water tank 44-1 is connected to the water pipe 44-2 to inject water into external soil, and the loading plate 44-4 is arranged at the end of the first guide rod 44-3, the loading plate 44-4 assists the water tank 44-1 to measure the slump modulus of the soil; through the method of loading and unloading the soil step by step by loading plate 44-4, the corresponding rebound deformation value of soil foundation under each load is measured, and the soil slump modulus is calculated.

The second mounting cavity 45 is equipped with the second guide rod 45-1, the strength probe 45-2 is set at the front end of the second guide rod 45-1, and the airbag 45-3 is set at the tail end of the second guide rod 45-1, the second guide rod 45-1 pushes the strength probe 45-2 into the soil to measure the soil strength through the compressed gas in the airbag 45-3; the strength probe 45-2 is inserted into the soil through the second guide rod 45-1 to measure the strength of the soil, that is, the soil compactness, which is expressed by the resistance when the metal plunger or probe is pressed into the soil, the soil compactness refers to the ability of the soil to resist the compaction and crushing of the external force, which is one of the aspects of soil properties. Soil compactness is a synthetic index of soil strength, which is composed of soil shear resistance, compression force, and friction force.

The third mounting cavity 46 is equipped with the moisture content detector 46-1 and the pressure sensor 46-2; the pressure sensor 46-2 detects the distribution and the size of the in-situ stress by contacting the hole wall. The thin film pressure sensor 46-2 adopts modern thin film preparation technology to deposit thin film strain resistors on metal elastic substrates, it has high precision, good creep resistance, strong anti-interference ability, and other properties. Preferably, this embodiment adopts the alloy thin film pressure sensor 46-2, the thin film resistance layer generates corresponding resistance changes by sensing the strain of the elastic element, and outputs the corresponding voltage signal through the signal conditioning circuit, thereby completing the conversion from non-electric quantity to electric quantity. The moisture content detector 46-1 is used to detect the soil moisture content at the specified position in the hole.

By adopting the above setting, the data collected by each component in the detection unit 40 is collected by the circuit board 46-3 and transmitted to the control unit 50.

The setting of loading plate 44-4, the strength probe 45-2, the moisture content detector 46-1, and the pressure sensor 46-2 can realize the measurement of soil mechanical parameters without stress release, the original soil morphology is not destroyed, detection accuracy is high, and the soil modulus can be measured under the original stress state. It overcomes the problems existing in the indoor test detection method and completes the in-situ detection under the actual environmental conditions of the detection area, the obtained test data is more reliable.

Furthermore, the outer diameter of the second outer shell 41 and the outer diameter of the cutting ring 23 are ±1 mm different from the outer diameter of the PDC bit 11. When the robot is retracted, the soil caused by the shrinkage of the hole is cut, the purpose of cutting ring 23 is to make the robot easy to retract and avoid the phenomenon of equipment blockage caused by the shrinkage of the soil hole, the setting here is also for the robot to carry out the in-situ detection of geological information without disturbance of in-situ stress.

By adopting the above setting, the outer surface of the detection unit 40 is basically in contact with the hole formed by the PDC bit 11, when the detection instrument is working, the rebound of the soil shrinkage hole is limited, which hinders the release of the in-situ stress around the borehole hole and minimizes the disturbance of the robot operation to the deep geological physical parameters, so that the robot can accurately obtain the in-situ geological information and reduce the cumulative error of geological information collection. When retracting the robot, the cutting ring 23 is set to cut the soil generated by the shrinkage of the hole, making it easy for the robot to retract.

Furthermore, the control unit 50 includes the computer 51, the power supply 53, the gas source 54, and the control circuit board 46-3, the computer 51 and the power supply 53 are connected to the robot by the cable 52, the gas source 54 is communicated with the first air pipe 31-4, the second air pipe 32-2 and the third air pipe 33-2 through the fifth air pipe 55, and the gas source is controlled by the second butterfly valve 56 for inflating and deflating gas.

The robot tail 57 is connected to the cable 52, which is continuously released through a drum and connected to the surface power supply 53 and the computer 51, the circuit board 46-3 is located on the inner wall of the detection unit 40, which is used to receive the information output by the detection system. At the same time, the information output by the detection system is processed and calculated, and the geological information of stress, modulus, water content, and strength is transmitted to the ground data acquisition center through the communication module carried on the control circuit board 46-3. It is also used to output the electrical signal to control the drive motor according to the received obstacle information and pressure information. The computer 51 is used to collect and analyze data and control the sequential action of each motor to achieve specific functions.

Furthermore, the pneumatic conveyor 22 includes the hopper 22-1, the pressure delivery tank 22-3, the mud pipe 22-9, and the ground mud pipe 22-10 connected in turn, the pressure delivery tank 22-3 is connected to the main pneumatic nozzle 22-5, the mud pipe 2-9 is connected to an auxiliary pneumatic nozzle 22-11, and the main pneumatic nozzle 22-5 and the auxiliary pneumatic nozzle 22-11 are connected to the gas storage tank 22-8.

Specifically, the soil drilled by the PDC bit 11 is sent to the robot tail 57 through the screw conveyor 21 and enters the hopper 22-1, after the soil reaches a certain amount, the feed butterfly valve 22-2 opens and the soil enters the pressure tank 22-3, the main pneumatic nozzle 22-5 blows the high-pressure gas in the gas storage tank 22-8 into the pressure tank 22-3 by the first butterfly valve 22-6 and the Laval nozzle 22-7, so that the soil enters the mud pipe 22-9 from the discharge butterfly valve 22-4 and the ground mud pipe 22-10, and discharges from the ground, the mud pipe 22-9 is equipped with the auxiliary pneumatic nozzle 22-11 to increase the conveying efficiency and prevent blockage.

Before drilling into the soil, a hole with a diameter similar to that of the robot can be artificially prefabricated, which makes the robot easy to move forward and also prevents the robot from destroying the soil structure due to the instability of the body during the initial drilling of the soil. The in-situ detection robot of the invention can realize the measurement of soil mechanical parameters under the condition of no stress release, it does not destroy the original soil morphology, the detection accuracy is high, and the soil modulus under the original stress state can be measured.

Embodiment 2

In this embodiment, the detection method of the in-situ detection robot for in-situ geological information without disturbance of in-situ stress in Example 1 is given. PDC bit 11 is used for drilling so that the drilled soil is discharged from screw conveyor 21 and pneumatic conveyor 22 to the ground. Radial expansion and contraction are realized by external gas source 54, successively acting on the front throttle airbag 31, the rear throttle airbag 32, and the adaptive airbag 33. Axial expansion and contraction are realized by axial contraction component 34, and environmental adaptation is realized. Forward and support actions are realized by sequential control of airbag 45-3 and second motor 21-2. The internal detection unit 40 detects the surrounding environment in real time. The data is transmitted to the ground computer 51 through the tail cable 52. When the forward direction encounters pore cracks, the adaptive airbag 33 acts to support the stability of the body.

The detection method of the in-situ detection robot for geological information without disturbance of in-situ stress in Embodiment 1 is disclosed, the PDC bit 11 is used for drilling to discharge the drilled soil to the ground by the screw conveyor 21 and the pneumatic conveyor 22, the fore-body airbag 31, the after-body airbag 32 and the adaptive airbag 33 are actuated in turn to realize the radial inflation and contraction through the external gas source 54, the axial expansion and contraction realized by the axial contraction component 34, and also an adaptive environment, the forward and supporting action is realized by sequentially controlling the airbag 45-3 and the second motor 21-2, the internal detection unit 40 detects the surrounding environment in real time, and the data is transmitted to the computer 51 on the ground through the cable 52 in the tail, the adaptive airbag 33 acts to support the stability of the body when encountering pore cracks in the forward direction.

Figure 12:
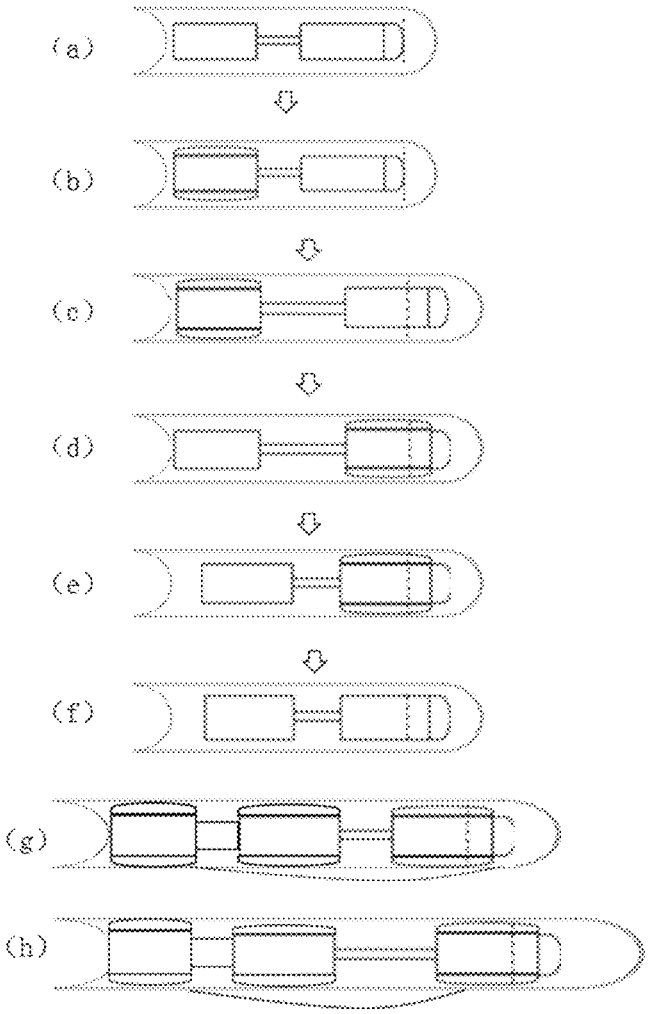
FIG. 12 is a schematic diagram of the principle of the robot achieves forward.

See FIG. 12, the forward motion cycle can be divided into 6 steps.

Step 1, as shown in FIG. 12*a*, the robot is in the initial state in the artificial prefabricated hole, the fore-body airbag 31 and the after-body airbag 32 are not inflated and in a contraction state, the PDC bit 11 is driven by the first motor 13 and the gear module 59, the robot cuts the soil to form holes on the one hand, and discharges the soil from the tail on the other hand.

Step 2, as shown in FIG. 12*b*, when the robot starts to drill, it becomes difficult for the robot to move forward, after the after-body airbag 32 is inflated through the second air pipe 32-2, and the hole wall formed by the PDC bit 11 drilling is supported.

Step 3, as shown in FIG. 12*c*, the third motor 34-3 drives the screw to rotate to lengthen the screw to a certain distance, and pushes the PDC bit 11 forward, the forward distance and forward speed can be determined by experiments, and the third motor 34-3 can accurately control the forward position of the robot.

Step 4, as shown in FIG. 12*d*, the fore-body airbag 31 is inflated and expanded by the first air pipe 31-4, while the after-body airbag 32 deflates and contracts, the contraction of the after-body airbag 32 begins after the fore-body airbag 31 supports the hole wall, and the robot stops moving.

Step 5, as shown in FIG. 12*e*, the inflation state of the fore-body airbag 31 is unchanged, and the third motor 34-3 drives the screw reversely to drive the after-body airbag 32 to move forward for a certain distance. At this time, the position of the robot is controlled by the fore-body airbag 31, so the screw nut 34-2 mechanism can move the maximum stroke to improve the robot's forward efficiency.

Step 6, as shown in FIG. 12*f*, the fore-body airbag 31 shrinks and the robot returns to the initial state.

At this point, the cycle of movement cycle is completed, and the robot moves forward a step as a whole, in the actual working process, the robot has no initial state to prevent the robot from falling or overturning, that is, the fore-body airbag and the after-body airbag are both in a contraction state, the motion state is repeated from the second part, which can realize the continuous advancement of the robot.

In special cases, such as (FIG. 12*g*), when the pressure of the fore-body airbag 31 and the after-body airbag 32 reaches the normal working pressure, the pressure sensor 46-2 measures that the airbag 45-3 does not have enough support for the hole wall, at this time, considering that the robot encounters large pores and cracks during the forward process, the fore-body airbag 31 and the after-body airbag 32 cannot be effectively supported. At this time, the adaptive airbag 33 will inflate and fix the robot in the hole to maintain the stability of the body, then the screw nut 34-2 mechanism is elongated to make the fore-body airbag 31 cross the pores or cracks to support the body.

The above description of the embodiment is to facilitate the general technical personnel in the technical field to understand and apply the invention. People who are familiar with the technology in this field can easily make various modifications to these embodiments, and apply the general principles described here to other embodiments without making any creative labor. Therefore, the invention is not limited to the embodiments here. According to the revelation of the invention, the improvements and modifications made by the technicians in this field should be within the protection scope of the invention.

What is claimed is:

1. An in-situ detection robot for geological information without disturbance of in-situ stress including a sleeve, wherein a drilling unit and a support propulsion unit are set from a top to a bottom outside the sleeve, a dumping unit is set inside the sleeve, a detection unit is set between the drilling unit and the support propulsion unit, and a robot tail is connected to a control unit;

the dumping unit is configured to discharge soil drilled from the drilling unit to a ground, the support propulsion unit provides support and helps to advance, move, and orient a robot body, and the detection unit is used to detect geological information of surrounding environment of the robot, the control unit is used to control the drilling unit, the support propulsion unit and the detection unit, and the control unit collects and processes the geological information transmitted by the detection unit; and the support propulsion unit includes a fore-body airbag, an after-body airbag and an adaptive airbag which are coaxially arranged from the top to the bottom outside the sleeve, the fore-body airbag and the after-body airbag are connected by an axial contraction component, the after-body airbag is fixed with the adaptive airbag, the axial contraction component cooperates with the fore-body airbag and the after-body airbag to realize an axial movement of the fore-body airbag and the after-body airbag along an outer wall of the sleeve, so that the robot moves forward, the adaptive airbag realizes an environmental adaptation of the robot so that the robot body maintains stability.

2. The in-situ detection robot for geological information without disturbance of in-situ stress according to claim 1, wherein the fore-body airbag includes a first inner shell that is slidingly sleeved on the sleeve, the first inner shell is connected to a first outer shell through a first reinforcing rib, a first air cavity is attached to an outer wall of the first outer shell, and a first air pipe connected to the first air cavity is circumferentially arranged on the first outer shell; and structures of the after-body airbag and the adaptive airbag are the same as that of the fore-body airbag, the after-body airbag includes a second air cavity and a second air pipe connected to the second air cavity, the adaptive airbag includes a third air cavity and a third air pipe connected to the third air cavity, the first air pipe, the second air pipe, and the third air pipe are all connected to an external gas source.

3. The in-situ detection robot for geological information without disturbance of in-situ stress according to claim 2, wherein the dumping unit includes a screw conveyor coaxial with the sleeve inside the sleeve, a pneumatic conveyor is connected to a bottom of the screw conveyor, the dumping unit also includes a cutting ring arranged at a bottom of the adaptive airbag, the screw conveyor conveys the soil cut by the PDC bit to the robot tail and discharges the soil cut by the PDC bit from the robot body through the pneumatic conveyor; and the PDC bit is provided with a drill cavity, and the screw conveyor includes a first spiral blade located in the drill cavity and a second spiral blade located throughout the sleeve, the first spiral blade and the second spiral blade are connected to a second motor with a double output shaft, a diameter of the first spiral blade is greater than that of the second spiral blade.

4. The in-situ detection robot for geological information without disturbance of in-situ stress according to claim 3, wherein the detection unit includes a second outer shell and a second inner shell coaxially arranged in the second outer shell, the second outer shell, and the second inner shell are divided into three mounting cavities by setting three second stiffeners, the three mounting cavities include a first mounting cavity, a second mounting cavity, and a third mounting cavity;

the first mounting cavity is equipped with a water tank and a first guide rod, the water tank is connected to a water pipe to inject water into external soil, and a loading plate is arranged at the end of the first guide rod, the loading plate assists the water tank to measure a slump modulus of the soil;

the second mounting cavity is equipped with a second guide rod, a strength probe is set at a front end of the second guide rod, and an airbag is set at a tail end of the second guide rod, the second guide rod pushes the strength probe into the soil to measure a soil strength through compressed gas in the airbag; and the third mounting cavity is equipped with a moisture content detector and a pressure sensor; the pressure sensor detects a distribution and a size of the in-situ stress by contacting a hole wall.

5. The in-situ detection robot for geological information without disturbance of in-situ stress according to claim 4, wherein an outer diameter of the second outer shell and an outer diameter of the cutting ring are ±1 mm different from an outer diameter of the PDC bit.

6. The in-situ detection robot for geological information without disturbance of in-situ stress according to claim 4, wherein the control unit includes a computer, a power supply, a gas source, and a control circuit board, the computer and the power supply are connected to the robot by a cable, the gas source is communicated with the first air pipe, the second air pipe and the third air pipe through a fifth air pipe, and the gas source is controlled by a second butterfly valve for inflating and deflating gas.

7. The in-situ detection robot for geological information without disturbance of in-situ stress according to claim 3, wherein the pneumatic conveyor includes a hopper, a pressure delivery tank, a mud pipe, and a ground mud pipe connected in turn, the pressure delivery tank is connected to a main pneumatic nozzle, the mud pipe is connected to an auxiliary pneumatic nozzle, and the main pneumatic nozzle and the auxiliary pneumatic nozzle are connected to the gas storage tank.

8. The in-situ detection robot for geological information without disturbance of in-situ stress according to claim 1, wherein the axial contraction component includes a third motor, a screw, and a screw nut, the third motor is fixed between a first outer shell and a first inner shell of the fore-body airbag, the third motor is connected to the screw, the screw nut is fixed between the first outer shell and the first inner shell of the after-body airbag, the third motor drives the screw to rotate, and then the drilling unit is driven forward for drilling, or the after-body airbag is driven forward, thereby driving the adaptive airbag forward.

9. The in-situ detection robot for geological information without disturbance of in-situ stress according to claim 1, wherein the drilling unit includes a PDC bit and a gear module set at a bottom of the PDC bit, the gear module includes an internal meshing large gear fixedly connected to the PDC bit, an internal meshing small gear set in the internal meshing large gear, and the internal meshing small gear is fixedly connected to a first motor, the first motor is set on the sleeve, and the first motor drives the internal meshing small gear to rotate, and then the internal meshing large gear is driven to rotate and the PDC bit is driven to rotate to realize a soil drilling.

10. A detection method of the in-situ detection robot for geological information without disturbance of in-situ stress according to claim 1, using the PDC bit for drilling to discharge drilled soil to the ground by the screw conveyor and the pneumatic conveyor, actuating the fore-body airbag, the after-body airbag, and the adaptive airbag in turn to realize a radial inflation and contraction through the external gas source, realizing an axial expansion and contraction by the axial contraction component, and also an adaptive environment, realizing a forward and supporting action by sequentially controlling a rubber airbag and a second motor, detecting the surrounding environment in real time by the internal detection unit, and transmitting the data to the computer on the ground through the cable in the tail, acting to support the stability of the body by the adaptive airbag when encountering pore cracks in the forward direction.

11. The detection method according to claim 10, wherein the fore-body airbag includes a first inner shell that is slidingly sleeved on the sleeve, the first inner shell is connected to a first outer shell through a first reinforcing rib, a first air cavity is attached to an outer wall of the first outer shell, and a first air pipe connected to the first air cavity is circumferentially arranged on the first outer shell; and structures of the after-body airbag and the adaptive airbag are the same as that of the fore-body airbag, the after-body airbag includes a second air cavity and a second air pipe connected to the second air cavity, the adaptive airbag includes a third air cavity and a third air pipe connected to the third air cavity, the first air pipe, the second air pipe, and the third air pipe are all connected to an external gas source.

12. The detection method according to claim 11, wherein the dumping unit includes a screw conveyor coaxial with the sleeve inside the sleeve, a pneumatic conveyor is connected to a bottom of the screw conveyor, the dumping unit also includes a cutting ring arranged at a bottom of the adaptive airbag, the screw conveyor conveys the soil cut by the PDC bit to the robot tail and discharges the soil cut by the PDC bit from the robot body through the pneumatic conveyor; and the PDC bit is provided with a drill cavity, and the screw conveyor includes a first spiral blade located in the drill cavity and a second spiral blade located throughout the sleeve, the first spiral blade and the second spiral blade are connected to a second motor with a double output shaft, a diameter of the first spiral blade is greater than that of the second spiral blade.

13. The detection method according to claim 12, wherein the detection unit includes a second outer shell and a second inner shell coaxially arranged in the second outer shell, the second outer shell, and the second inner shell are divided into three mounting cavities by setting three second stiffeners, the three mounting cavities include a first mounting cavity, a second mounting cavity, and a third mounting cavity;

the first mounting cavity is equipped with a water tank and a first guide rod, the water tank is connected to a water pipe to inject water into external soil, and a loading plate is arranged at the end of the first guide rod, the loading plate assists the water tank to measure a slump modulus of the soil;

the second mounting cavity is equipped with a second guide rod, a strength probe is set at a front end of the second guide rod, and an airbag is set at a tail end of the second guide rod, the second guide rod pushes the strength probe into the soil to measure a soil strength through compressed gas in the airbag; and the third mounting cavity is equipped with a moisture content detector and a pressure sensor; the pressure sensor detects a distribution and a size of the in-situ stress by contacting a hole wall.

14. The detection method according to claim 13, wherein an outer diameter of the second outer shell and an outer diameter of the cutting ring are ±1 mm different from an outer diameter of the PDC bit.

15. The detection method according to claim 13, wherein the control unit includes a computer, a power supply, a gas source, and a control circuit board, the computer and the power supply are connected to the robot by a cable, the gas source is communicated with the first air pipe, the second air pipe and the third air pipe through a fifth air pipe, and the gas source is controlled by a second butterfly valve for inflating and deflating gas.

16. The detection method according to claim 12, wherein the pneumatic conveyor includes a hopper, a pressure delivery tank, a mud pipe, and a ground mud pipe connected in turn, the pressure delivery tank is connected to a main pneumatic nozzle, the mud pipe is connected to an auxiliary pneumatic nozzle, and the main pneumatic nozzle and the auxiliary pneumatic nozzle are connected to the gas storage tank.

17. The detection method according to claim 10, wherein the axial contraction component includes a third motor, a screw, and a screw nut, the third motor is fixed between a first outer shell and a first inner shell of the fore-body airbag, the third motor is connected to the screw, the screw nut is fixed between the first outer shell and the first inner shell of the after-body airbag, the third motor drives the screw to rotate, and then the drilling unit is driven forward for drilling, or the after-body airbag is driven forward, thereby driving the adaptive airbag forward.

18. The detection method according to claim 10, wherein the drilling unit includes a PDC bit and a gear module set at a bottom of the PDC bit, the gear module includes an internal meshing large gear fixedly connected to the PDC bit, an internal meshing small gear set in the internal meshing large gear, and the internal meshing small gear is fixedly connected to a first motor, the first motor is set on the sleeve, and the first motor drives the internal meshing small gear to rotate, and then the internal meshing large gear is driven to rotate and the PDC bit is driven to rotate to realize a soil drilling.

* * * * *